United States Patent [19]

Andersson

[11] 4,069,781

[45] Jan. 24, 1978

[54] PROTECTIVE COVER, PARTICULARLY AN ANTIMACASSAR

[75] Inventor: Karl Gosta Bertil Andersson, Halmstad, Sweden

[73] Assignee: Duni Bila AB, Halmstad, Sweden

[21] Appl. No.: 657,170

[22] Filed: Feb. 11, 1976

[30] Foreign Application Priority Data

Feb. 20, 1975 Sweden ..... 7501917

[51] Int. Cl.[2] ..... D05B 93/00

[52] U.S. Cl. ..... 112/438; 297/220; 2/DIG. 6

[58] Field of Search ..... 112/438, 429, 410, 197; 428/99, 100; 2/DIG. 6; 297/220, DIG. 6

[56] References Cited

U.S. PATENT DOCUMENTS

| | | | |
|---|---|---|---|
| 734,574 | 7/1903 | Kramer | 112/197 |
| 3,266,841 | 8/1966 | Altman | 297/220 |
| 3,804,458 | 4/1974 | Jannoni | 297/DIG. 6 X |
| 3,943,981 | 3/1976 | Brabander | 428/99 X |

*Primary Examiner*—Werner H. Schroeder
*Assistant Examiner*—Peter Nerbun
*Attorney, Agent, or Firm*—Ostrolenk, Faber, Gerb & Soffen

[57] ABSTRACT

The invention relates to a protective cover of fibre material such as non-woven material, intended to be applied as a cover on a substructure such as those intended for sitting or lying, for example as an antimacassar for seats, there being at least one row of stitching running across the cover and made as double chain stitching with such thread structures that it forms an attachment for the hooks of a burr strip attached to the substructure. The upper thread of the double chain stitching consists of a relatively highly elastic thread of multifilament type having crimped filaments, the upper thread forming consecutive loops on the lower side of the cover in a known way, while the lower thread of the double chain stitching consists of a cotton or cotton-synthetic thread which is relatively unelastic in relation to the upper thread. Further, the tension in the upper thread is less than the tension in the lower thread so that the upper thread assumes its fluffy and voluminous condition to thereby form an easily entanglable fastening for the hooks of the burr strip.

7 Claims, 8 Drawing Figures

PROTECTIVE COVER, PARTICULARLY AN ANTIMACASSAR

Figure 1:
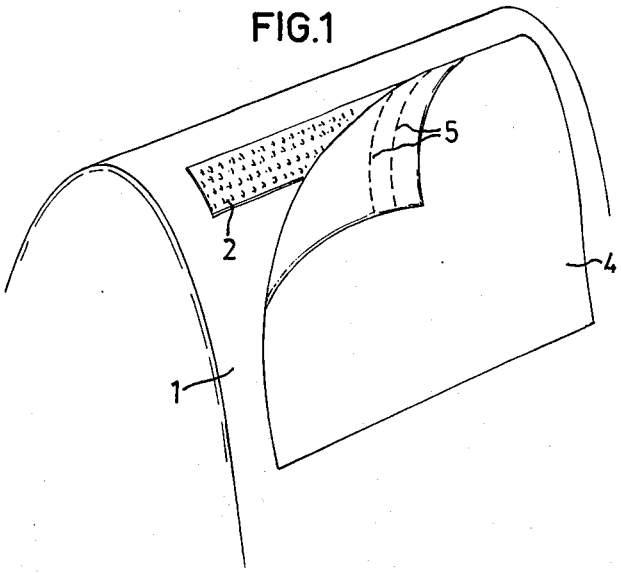

The present invention relates to a protective cover or protective fabric, particularly an antimacassar, intended to be placed on seat backs, the cover consisting of a sheet-like cellulose fibre material provided with at least one row of stitching intended to form fastenings for a burr strip attached to the substructure to which the cover is to be fastened. The cover is intended to be disposable. By "burr strip"is intended here a strip of material having a multiplicity of small hooklike elements throughout the surface.

Such a cover with at least one such row of stitching is described and shown in the British Pat. No. 1,335,982, where the stitching is shuttle seam or stitching seam. In practice shuttle seam is less suitable for the purpose, and instead there is therefore used a stitching seam of the double chain stitch type of conventional appearance with an upper thread and a lower thread, In the known stitching on protective covers of non-woven fibre structure or the like, both the upper and lower threads consist of a multifilament thread which in an untensioned state is fluffy and voluminous, where the crimped filament threads are of synthetic material. A suitable thread of this type is marketed by ICI as crepe nylon thread. In the known cover, the loops of the stitching will be relatively severely stretched, which has as a result that the upper thread does not assume its fluffy and voluminous condition. Instead, the filament threads which are crimped in an untensioned state lie relatively severely stretched and closely adjacent each other, their crimped shape therefore being more or less heavily extended. The stretched upper thread is given a diameter which is reduced many times in relation to the diameter in an unstretched condition. Even if this stitching functions relatively satisfactorily in practice, it is however so executed that it does not make use of the qualities of the upper thread, which is fluffy in its unstressed condition, to form a fastening in the best possible way, which can be positively gripped by the hooks in the burr strip.

The object of the present invention is therefore to provide double chain stitching containing at least one multifilament thread of synthetic filaments, where the stitching forms an improved fastening for the hooks in the burr strip in relation to the type of double chain stitch used up to now for the purpose in question.

This is achieved according to the invention by the upper thread consisting of the previously used highly elastic multifilament thread or a corresponding thread with a relatively large number of crimped filaments of synthetic material, while the lower thread consists of a relatively unelastic cotton thread. The lower thread can thereby consist of a cotton thread having two twisted strands of cotton or suitably a polyester thread spun round with cotton.

When the upper thread is sewn on together with the lower thread, practically no tension is maintained in the upper thread, while the lower thread according to the invention is heavily stressed in relation to the upper thread. These characteristics of the stitching can be selected by adjusting the sewing machine. When the sewing needle is at its bottommost position, the loop formed from the upper thread has its largest size. According to the invention this size shall be maintained as large as possible, which is achieved by the lower thread defined according to the invention to a certain extent taking hold of the loop with the aid of the cotton fibre projections found in a cotton thread, and with the aid of the helix groove between the twisted cotton strands or the cotton thread spun around the polyester core. The thread tensioner on the sewing machine is thereby adjusted for least possible tension in the upper thread, and is thereby unable to withdraw the loop in a normal way when the needle moves upwards, since the normal withdrawal is braked by the lower thread, which is adjusted to give greater braking force than the braking force which is set on the thread tensioner.

The stitching will hereby consist of loose loops with practically tensionless fluffy parts or loop halves which at the throat of the loop are bound together by the relatively heavily tensioned lower thread. The hooks of the burr strip thus come into contact with a loose bunch of thread filaments and can easily be entangled in these to obtain a positive grip on several filaments.

To advantage, the upper thread can consist of two parallel multifilament threads each having about half as large a diameter as a single upper thread. In this case satisfactory thread bunching is still obtained while there is a certain economy of the thread material in relation to the said single thread.

A suitable embodiment of the invention will now be explained more closely while referring to the attached drawings.

Figure 2:
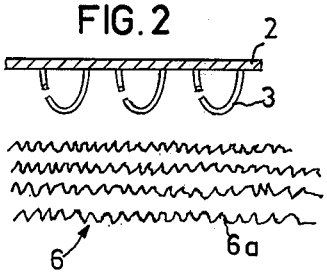
Figure 3:
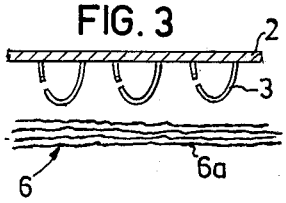
Figure 8:
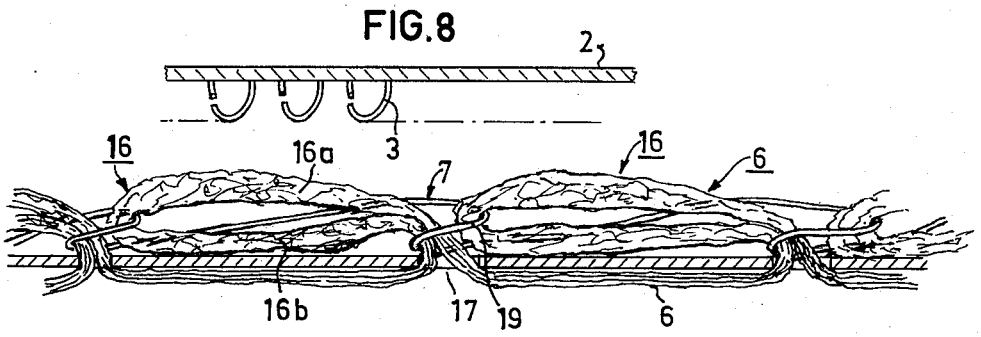
Figure 4:
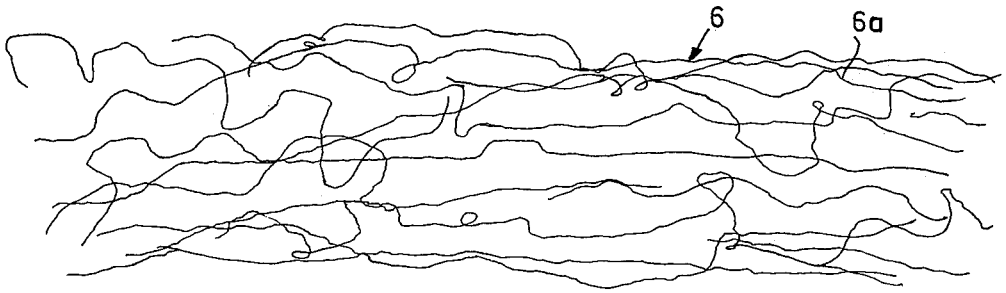
Figure 5:
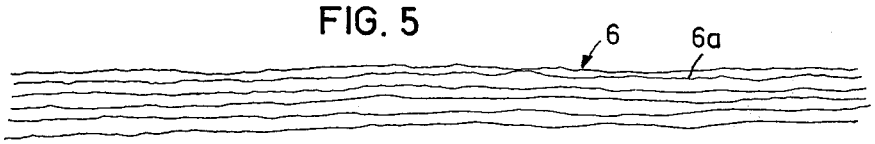
Figure 6:
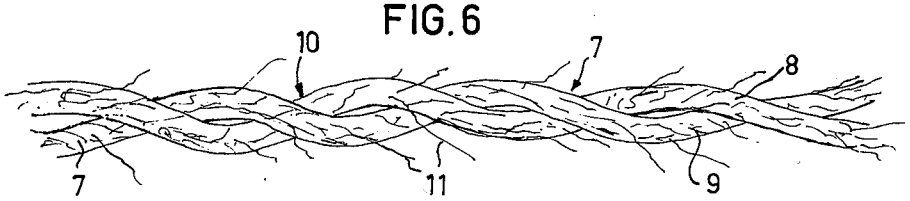
Figure 7:
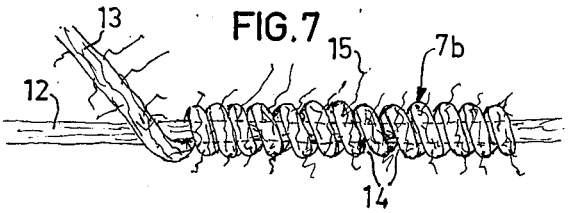

FIG. 1 shows a protective cover used as an antimacassar on a seat back,

FIG. 2 schematically shows a fluffy multifilament thread in an untensioned condition, and hooks for engaging with the thread, FIG. 3 shows the same hooks and the same thread but now with the thread in a tensioned condition, FIG. 4 shows, heavily enlarged, the multifilament thread in an untensioned condition and forming a fluffy thread with crimped thread filaments, FIG. 5 shows the upper thread in FIG. 4 in a stretched condition, FIG. 6 shows, heavily enlarged, a lower thread consisting of two twisted cotton strands, FIG. 7 shows a lower thread in the form of a polyester thread core spun round with cotton thread, FIG. 8 is a schematical section through a cover provided with double chain stitching according to the invention.

On the seat back 1 in FIG. 1 there is attached a burr strip 2 with a large number of hooks 3 of a known type, e.g. those shown schematically in FIGS. 2 and 3.

The cover 4 consists of a rectangular piece of fabric having for example cellulose fibre structure of the non-woven type. In the cover there have been made two rows of stitching 5 lying side by side at a distance which is substantially less than the width of the burr strip. In certain cases it is sufficient with one row of stitching 5. The stitching is made with a so-called double chain stitch with an upper thread and a lower thread, the upper thread 6 forming consecutive loops which are held together with the help of the lower thread 7 in principle in the way apparent from FIG. 8.

The upper thread 6 consists of a multifilament thread which in an untensioned condition is fluffy and voluminous, with a large number of crimped filaments **6*a* of synthetic material, as is schematically indicated in FIGS. 2, 4 and 5**.

When the upper thread 6 is stretched, the crimped synthetic filaments **6*a*** are straightened to a greater or less extent and are forced together so that the upper thread 6 obtains a diameter many times less than in the unstretched condition as is indicated schematically in FIGS. 3 and 5. The upper thread may be characterized as a highly elastic thread with smooth thread filaments.

Two examples *7a, 7b* of the lower thread 7 are shown schematically in FIGS. 6 and 7.

In FIG. 6 the lower thread *7a* consists of two cotton threads 8, 9 twisted together with an intermediate helical groove 10, the thread having a large number of projecting fibres 11.

In FIG. 7 the lower thread *7b* consists of a practically unelastic thread having a core of polyester thread 12 spun round with a twisted cotton thread 13. The turns give the lower thread a screw thread-like surface with a helix groove 14 and projecting cotton fibres 15. Such lower threads can engage the filament threads *6a* of the upper thread in the way described in the introduction.

It may be seen from FIGS. 2 and 3 the it is easier for the hooks 3 to entangle with the thread 6 when this is completely untensioned, or is substantially less stretched in relation to the same thread, than when it is in the stretched condition according to FIG. 3, used in known stitching. This condition is utilized in the stitching according to the invention, as illustrated in FIG. 8.

The stitching can be carried out with an industrial sewing machine of standard type, where the tension in the upper thread and lower thread can be adjusted as desired.

When adjusting the sewing machine for stitching according to the invention, the tension of the upper thread is adjusted to be merely a fraction of the tension in the lower thread, in most cases less than 1/10 of the lower thread tension. In certain cases tension in the upper thread can be practically zero.

This results in stitching having in principle the schematic appearance as shown in FIG. 8.

On the lower side of the cover there are obtained consecutive loops of the upper thread 16, the two parts *16a, 16b* of the loop not lying stretched tightly against each other but are practically without tension, the parts curving away from each other to a greater or less extent to assume the fluffy voluminous thread condition according to FIG. 8.

At the necks of the loop 16, the parts *16a, 16b* extend through the holes 17 formed by the sewing needle in the cover, and adjacent these holes are relatively heavily pulled together by the lower thread tightening double 19, running around the neck of one loop and through the next adjacent loop of the upper thread working from right to left to pull the neck together with the double as shown in FIG. 8. This tightening is positive since the surface structure of the lower thread 7 gives sufficient grip in the upper thread 6.

What I claim is:

1. An inexpensive disposable protective cover of fibre material such as non-woven material, intended to be applied as a protective cover on a substructure such as those intended for sitting or lying, e.g. as an antimacassar for seats, there being at least one row of stitching running across the cover and sewn into the cover in double chain stitching fashion with such thread structure that it forms an attachment for the hooks of a burr strip attached to the surface of the aforesaid substructure, characterized in that an upper thread and a lower thread are used to form the stitching, the upper thread of the double chain stitching consists of a relatively highly elastic thread of multifilament type having crimped filaments which are loosely arranged to form a fluffy thread, the upper thread being sewn through the cover and forming consecutive loops on the lower side of the cover and consecutive portions on the upper side of the cover, while the lower thread of the double chain stitching consists of a cotton or cotton-synthetic thread which is relatively unelastic in relation to the upper thread, and that the tension in the upper thread is less than the tension in the lower thread to that the upper thread assumes its fluffy and voluminous condition on the lower side of the cover to thereby form an easily entanglable fastening for the hooks of the burr strip.

2. A cover as claimed in claim 1, characterized in that the lower thread consists of two cotton strands twisted together.

3. A cover as claimed in claim 1, characterized in that the lower thread consists of a polyester thread spun about with a cotton thread.

4. A cover as claimed in claim 1, characterized in that the tension in the loops of the upper thread along the side of the cover is practically zero, and that the length of the thread portion forming the respective loop or its parts measured from the hole in the cover through which the parts of the loop are pulled during the sewing operation is at least twice as large as the distance between adjacent stitching holes caused by the needle in the cover.

5. A cover as claimed in claim 1, characterized in that the upper thread consists of two separate threads of crimped multifilament threads of synthetic material.

6. A cover as claimed in claim 4 wherein the lower thread is pulled around the neck of each loop and the center of the next adjacent loop to hold the loops of the upper thread along the lower side of the cover.

7. The cover as claimed in claim 4 wherein the lower thread lies exclusively along the lower side of the cover.

* * * * *